US005345219A

United States Patent [19]

Rogers

[11] Patent Number: 5,345,219

[45] Date of Patent: Sep. 6, 1994

[54] ANTI-THEFT ALARM FOR DISPLAYED GARMENTS

[75] Inventor: Robert Rogers, Ontario, Canada

[73] Assignee: Protex International Corp., Bohemia, N.Y.

[21] Appl. No.: 897,401

[22] Filed: Jun. 12, 1992

[51] Int. Cl.[5] ..... G08B 13/14

[52] U.S. Cl. ..... 340/568; 70/59; 340/687

[58] Field of Search ..... 340/568, 687; 70/59

[56] References Cited

U.S. PATENT DOCUMENTS

| | | | |
|---|---|---|---|
| 3,253,270 | 5/1966 | Downer | 340/568 |
| 4,598,827 | 7/1986 | Keifer | 70/59 |
| 4,620,182 | 10/1986 | Keifer | 340/686 |
| 4,746,909 | 5/1988 | Israel et al. | 340/568 |

*Primary Examiner*—Glen R. Swann, III
*Attorney, Agent, or Firm*—Eugene E. Renz, Jr.

[57] ABSTRACT

A security system for use with garments and the like mounted for display on a display fixture includes an alarm box adapted to be mounted at a location proximate display fixture, with a key switch for arming and disarming an alarm contained therein. The alarm box sounds an alarm when security conditions are breached. A plurality of garment cables connect individual garments to the system by use of plugs and jacks. A common cable connects the plurality of garment cables to a common connection using jack ports for receiving plugs on each of the garment cables. The common cable connector is adapted to fasten the common cable connector to a garment display fixture. The common cable connector includes a cover protectively enclosing the jacks so that the common cable connector may be locked when the cover is in a closed position. The cover is hinged with internal hinge to prevent access to the hinge in the closed position. The system has at least one alarm cable for connecting the alarm box and the common cable connector to complete an alarm circuit. The alarm circuit is operable to activate the alarm upon breach of security conditions on any one of the garment cables, the alarm cable or the alarm box.

19 Claims, 2 Drawing Sheets

ANTI-THEFT ALARM FOR DISPLAYED GARMENTS

FIELD OF THE INVENTION

The present invention relates to mechanical security systems particularly adapted for providing protection against shoplifting of merchandise such as garments displayed on garment fixtures or racks. More particularly, the present invention provides a mechanical fastening system for use with electronic security devices which is of comparatively simplified construction and is characterized by novel features of construction and arrangement providing versatile adaptation to existing furnishings and store fixtures in garment display sections of stores while providing maximum accessibility to individual items of merchandise or apparel displayed on the racks or fixtures.

BACKGROUND OF THE INVENTION

Clothing sales are primarily made by displaying the garments on open racks such that customers may put on the clothing to determine proper fit and may view themselves in the clothing to determine the appropriate aesthetic appeal. However, nicer items such as suits and coats or other outerwear garments have a relatively high value, and concern for security is important. Accordingly, efforts have been made to reduce the likelihood of theft or other unauthorized removal of the garments from the store.

Security devices for garments are, of course, not new per se. A number of systems have been proposed which allow the potential customer to inspect the items in a display rack or fixture without setting off an alarm and at the same time preventing the removal of the item from the immediate vicinity of the display. A typical system involves the step of threading a single steel cable through all the garments on a particular rack, such that the ends of the cable are secured by a locking mechanism to the rack. This system has an obvious drawback in that garments are not capable of being put on by the customer nor are they capable of being purchased until such cable is removed. That is not convenient, even if the desired garment is close to the end of the cable. Particularly with jackets and coats, such a removal and reinsertion process for the steel cable is both time consuming and not conductive to what are called impulse sales.

Attaching an individual cable to each garment is a known way to resolve the difficulties of collective security attachment. It is desirable that a customer be able to select a number of garments from a rack of clothing, try on the several garments, and reach the point of decision to purchase a particular item. One system which has been found to be effective for both security and display of clothing is described in U.S. Pat. No. 4,598,827. This system includes a housing in which a plurality of cables are employed, with each cable being attached at one end to the garment and at the other end to the housing. The attachment to the housing is detachable, such that any one or more individual cables can be removed or attached to the housing without disturbing the other cable attachments.

One method of attaching the cable to the garment is shown in this patent, where a cable is passed through an opening such as a buttonhole in the garment, where the cable has an enlarged plastic button at one end to prevent that end from passing through the opening. The other end of the cable is then attached to the security monitoring housing. The problem with this system, which has been effective up to a point, is that the security housing is attached to a stanchion of the supporting rack by suitable bolts or screw-type fasteners, thereby exposing the security system to direct tapering. Also, the cable shown in this patent is not secure against cutting, and would not send an alarm if cut and removed from the garment.

Another system of garment security and protection is shown in U.S. Pat. No. 4,620,182. In this system, an alarm mechanism is employed for signaling a closed circuit condition, such as when the cable which mechanically connects the retail item to the security device is cut. This system has been found to be effective in securing garments which have been displayed on a rack or other store fixture by attaching to the garment as in the prior patent discussed above and to the housing by plugging the other end of the cable into a jack or other electrically connecting fixture.

In this system, the cable is also sensitive to being cut and will sound an alarm via the disclosed electronic circuitry when, for example, a pair of conductive elements are contained in the cable and complete a circuit when joined together by actions such as cutting of the cable. The system is very effective in some situations, but concern for having exposed ports for attachment of the cable still exists. It is possible for clever shoplifters to tamper with the cable ports, such as by inserting of an element into the port to keep the system in steady state even when the cable is cut. Since the system operates on battery, and since it is in a normally open circuit condition, to preserve battery power, jamming an object into the port might be possible, whereby the circuit would not be completed upon removal of the jack from the port.

None of the prior art systems provide for complete security, particularly for the attachment of the cable to the security housing. This has been found to be the point where the security system is most likely to fail, either from inattentive or careless use by the sales personnel. For example, if the jack is not properly inserted into the plug when the garment is placed in the system, it may be removed without alarming the system because it has not been placed fully into the system. Alternatively, failure to lock the unit because of neglect or because the sales person is trying to show several customers several garments at the same time will permit unauthorized removal of additional garments by someone in the midst of the confusion and focused attention on others. It is of prime importance that the connection to the alarm box or security monitoring/alarm sending unit not be disturbed every time that a customer wishes to try on a garment. It is also important that the overall security not be disturbed each time one garment is removed from the system, such as when one garment has been sold.

Accordingly, it is an object of the present invention to provide a security system for garments such as jackets and coats and the like which allows for access to each individual item on the display rack or fixture.

Another object of this invention is to provide a system in which individual cables are attached to garments at one end and is secured to the security system at the other end of the cable in such a manner as to prevent access to the junction of the cable and the system.

Yet another object of the present invention is to provide a system in which the cable and security housing connection is not capable of being disabled by preventing access to the connection in a normal operating condition.

Still another object of the present invention is to provide a backup safety connection between the electronics of the security housing and the cable so that inadvertent or intentional disabling of the first connection will not prevent the second connection from serving as a security monitor and alarm system.

Other objects will appear hereinafter.

SUMMARY OF THE INVENTION

It has now been discovered that the above and other objects of the present invention may be accomplished in the following manner. Specifically, the present invention provides a security system for use with garments and the like mounted for display on a display fixture to provide an alarm upon breach of security conditions.

The system includes an alarm box, a plurality of garment cables connecting the garments individually to a common cable connector and through that connector to an alarm cable which in turn is connected to the alarm box.

The alarm box is mounted at a location proximate a display fixture, such as on the vertical section of a coat rack or the like. The box is provided with a switch for arming an alarm contained in the box. The alarm box is adapted to sound the alarm when security conditions are breached. Security conditions include any intrusion into the integrity of the alarm box itself as well as cutting or other damage to any of the cables in the system or to the connector. The alarm box includes a key for locking the switch in on or off conditions.

Also included in the system is a plurality of garment cables for connecting individual garments to the system by use of plugs and jacks. The garment cables connect to the garments in various ways, such as by use of a large button at one end which prevents the cable from being pulled completely through a button hole after it has been inserted through the button hole.

Also provided is a common cable connector for connecting the plurality of garment cables to a common connection using jack ports for receiving plugs which have been provided on one end of each of the garment cables. These plug and jack connections make a connection between the cable and the connector which permits the transmission of a security breach signal to the system. The common cable connector in most cases is fastened to a garment display fixture.

It is desirable to protect the common cable connector by enclosing the jacks so that the common cable connector may be locked In a closed position with a key, again for the integrity of the system. The cover is hinged with an internal hinge to prevent access to the hinge in the closed position.

Finally, the system has at least one alarm cable for connecting the alarm box and the common cable connector to complete an alarm circuit. The alarm circuit is operable to activate the alarm upon breach of security conditions on any one of the garment cables, the alarm cable or the alarm box.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
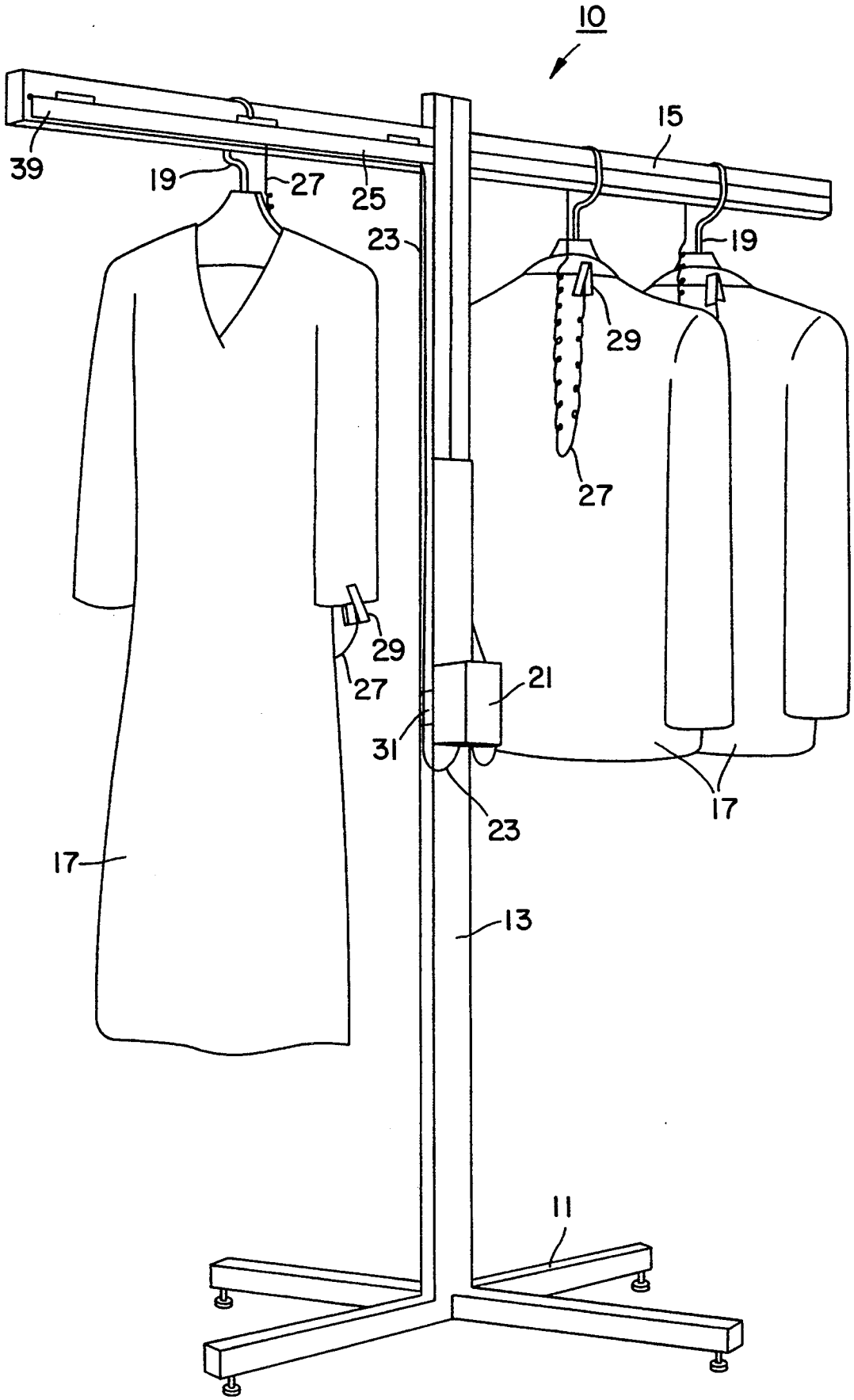
FIG. 1 is a perspective view of a security system and device in accordance with the present invention, showing the security device mounted on a display fixture and various garments also connected to the system.

As shown in the drawings, a security system, 10 generally, is intended for use with a clothing rack 11 or other display fixtures. Rack 11 includes a vertical portion 13 which extends up to the horizontal member 15 which is disposed to hold garments 17 which have been hung on hangers 19. While one form of clothes rack has been shown, it is to be understood that any display fixture can be used in combination with the present invention and such is the intention herein.

Figure 2:
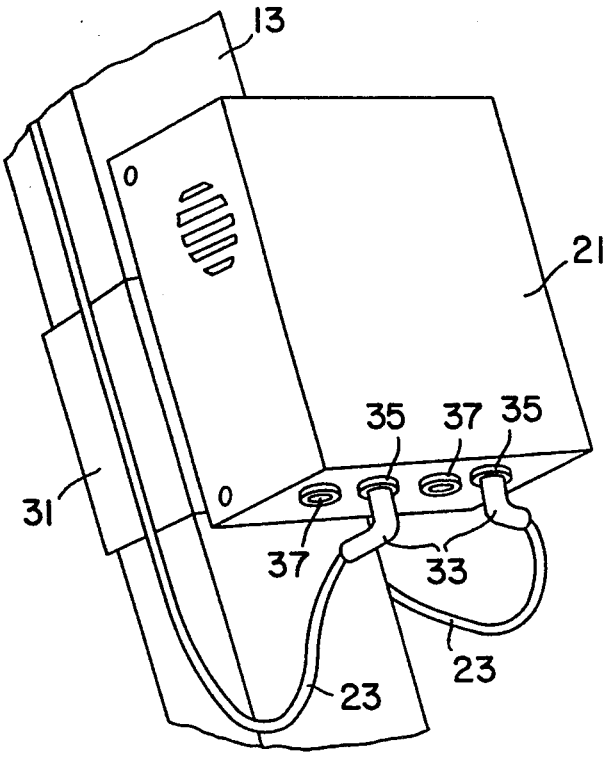
FIG. 2 is an enlarged view of a portion of the system, showing specific details thereof.

The heart of the security system of this invention is an alarm box 21, which is mounted by strap 31 on vertical section 13 of the clothes rack 11. Extending from alarm box 21 is at least one alarm cable 23 which, as shown in FIG. 2, is attached to alarm box 21 by plug 33 into jack 35. Alarm cable 23 is connected to a common cable connector means 25, shown in detail in FIG. 3. Also connected to common cable connector means 25 are a plurality of garment cables 27. Garment cables 27 are connected to garments 17 by a garment cable attachment clip 29, illustrated in FIG. 1.

Garment cable attachment clip 29 is disclosed in a commonly owned, co-pending application, Ser. No. 07/897,707, entitled ELECTRONIC SECURITY CLIP DEVICE, and filed of even date herewith, the disclosure of which is incorporated herein by reference. It is to be appreciated, however, that the present invention operates effectively with other garment attachment devices such as the simple enlarged plastic button disclosed in the previously identified U.S. Pat. No. 4,598,827.

In the preferred embodiment, cables 23 and 27 are designed to provide a signal when cut or otherwise removed. A preferred cable is disclosed in previously identified U.S. Pat. No. 4,620,182, the disclosure of which is also incorporated herein by reference. In that patent, the cable contains a pair of conductive elements, such as are included in coaxial cable such as COLUMBIA FLEX FOAM 1359, manufactured by Columbia Electronic Cables, of Pawtucket, R.I. As described in U.S. Pat. No. 4,620,182, any attempt to cut or otherwise remove the cable causes completion of an electronic circuit which then activates the alarm.

Thus, both alarm cable 23 and garment cables 27 will complete an electronic circuit when they are cut to notify the existence of a security condition. The system is connected to the alarm cable 23 and to the garment cables 27 via common cable connector means 25. Alarm box 21 includes an on/off switch 37 which is preferably operated by a key (not shown) such as is described in the aforementioned U.S. Pat. No. 4,620,182. Alarm box 21 has tile same electronic circuitry as described therein.

Figure 3:
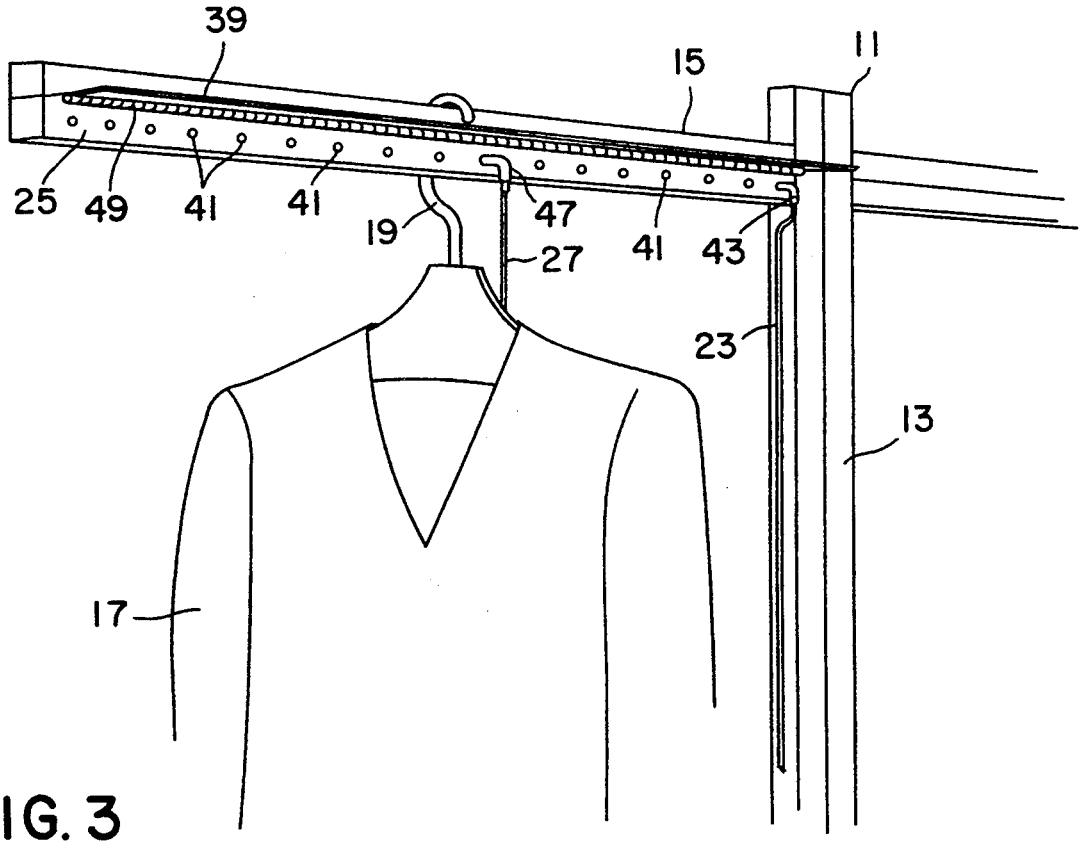
FIG. 3 is a perspective view, partially cut away, showing enlarged details of a portion of the system shown in FIG. 1.

The connection of the alarm cable 23 and the garment cables 27 is protected by a cover 39 mounted on the horizontal member 15 of rack 11. Under cover 39 are a plurality of jacks 41, which forth part of common cable connector means 25 and which connect to each other and to any element inserted into the jacks 41. Plug 43 on alarm cable 23 is inserted into one of jacks 41, thereby connecting the common cable connector means 25 to the alarm box 21. Each garment cable 27 includes a plug 47 which also connects the individual cables to the alarm box via common cable connector means 25. Cover 39 can then be closed over jacks 41, preventing unwanted removal of any of the plugs 47 or 43 therefrom. In a preferred embodiment, cover 39 is mounted via hinge 49, which, as shown in FIG. 3, has the hinge portion on the inside for visual appearance and for security reasons to deny access to hinge 49 when cover 39 is closed.

In operation, a plurality of garment cables 27 are attached via clip 29 or other means to garments 17. Persons interested in examining a garment or trying it on can do so without having to remove the clip 29 from the garment. In a preferred embodiment, garment cables 27 are long enough or are coiled with high memory coils to permit the potential customer to move to a mirror or model the garment for those who are accompanying the shopper. Any attempt to cut garment cables 27 or remove a clip 29 will cause a circuit to be completed, as described in previously incorporated U.S. Pat. No. 4,620,182, and alarm box 21 will sound an alarm.

Once the customer has decided to purchase one or more garments from the display fixture, the sales clerk turns switch 37 to the off position and removes clip 29. In instances where a plastic button type fastener is used to attach the garment cable 27 to the garment 17, the garment cable 27 will be reversibly fed through the button hole as shown in previously identified U.S. Pat. No. 4,598,927. In either case, the customer will be able to pay for and take home the garment of choice without disturbing the alarm system. Of course, the sales clerk will immediately re-alarm the system by turning switch 37 to the on or operating condition so that all of the remaining garments are secure. In some devices, several switches 37 are employed, and each switch 37 controls one alarm cable 23 and its attendant common cable connector means 25.

The system described herein is adapted to prevent loss of goods by sounding an alarm. Accordingly, cutting of any of the cables will sound an alarm. The common cable connector means 25 includes two tracks of conductivity, as shown in U.S. Pat. No. 4,620,182, which are separated by insulation or spacing in a normal operating condition. Jacks 41 and plugs 43 and 47 operate on the principle described in this patent to keep the two tracks of conductivity separated. Thus, when a cable is cut, the circuit is completed and will sound the alamo. Also, as a plug is removed from a jack, a temporary condition of complete circuit exists, again causing the alarm to be sounded. As noted in the incorporated patent, the removal and insertion of a plug can only be done when the alarm is off unless it Is intended to actuate the alamo.

While particular embodiments of the present invention have been illustrated and described, it is not intended to limit the invention, except as defined by the following claims.

I claim:

1. A security system for protecting merchandise hanging from a display fixture, comprising:

a plurality of alarm signal generation means, at least one signal generation means connected to each item of merchandise to be secured and operative to provide an alarm signal in response to a security breach;

a plurality of electrically-conducting cables connected to the alarm signal generation means;

a common cable connector means, located substantially coterminously with a structural member of the display fixture which supports the hanging merchandise, for connection with the plurality of cables; and an alarm, including an alarm cable for electrically connecting the alarm to the common cable connector means, to complete an alarm circuit for each item of merchandise hanging from the display fixture, whereby the alarm is activated in response to the alarm signal.

2. The system of claim 1 further comprising switch means connected to the alarm for arming said alarm.

3. The security system of claim 1 wherein the common cable connector means includes a plurality of electrical connecting means located along the entire length of the structural member, and positioned proximate of the area from which the merchandise hangs to further prevent the entanglement of the plurality of cables connected to the individual items of merchandise.

4. The security system of claim 3 wherein the plurality of cables include a plug means at one end, and the plurality of electrical connecting means include a jack means for receiving the plug means.

5. The system of claim 4 wherein each alarm signal generation means is a switch.

6. The system of claim 4, wherein said alarm includes key means for locking said switch means in on or off conditions.

7. The system of claim 4, wherein said common cable connecting means includes cover means for protectively enclosing said jack means.

8. The system of claim 3, wherein said cover means is hinged with internal hinge means to prevent access to said hinge means.

9. The system of claim 1 wherein the alarm is mounted at a location proximate the display fixture.

10. The combination of a security system with a garment display rack, comprising:

a generally vertically disposed first support member;

a second support member attached to the first support member and adapted to hang garments therefrom;

a plurality of alarm signal generation means, at least one signal generation means attached to each garment hanging on the rack for generating an alarm signal in response to a breach of a security condition;

a garment cable electrically connected to each alarm signal generation means;

a common cable connector means, including a plurality of electrical connection means for connection with the garment cables, attached to the second support member and located substantially along the entire length of the second support member, each garment being arranged to hang from the second support member in a position proximate an electrical connection means thereby allowing each respective garment cable to lay substantially next to the garment it is protecting to prevent the entanglement of the garment cables; and an alarm, electrically connected to the common cable connector means and activated upon detection of the alarm signal.

11. The combination of claim 10 wherein the garment cables include a plug means at one end and each electrical connection means includes a jack means for receiving the plug means.

12. The combination of claim 11, wherein the jack means are equidistantly spaced along the second support member.

13. The combination of claim 12, further comprising a cover means attached to the second support member for protectively enclosing the jack means.

14. The combination of claim 12, wherein the second support member is disposed substantially horizontally.

15. The combination of claim 14, wherein the alarm is attached to the first support member.

16. The system of claim 13, wherein said cover means is hinged with internal hinge means to prevent access to said hinge.

17. The combination of claim 10, wherein the alarm signal generation means is a switch.

18. A security system for use with merchandise hanging from a display fixture, comprising:

a plurality of alarm signal generation means, at least one alarm generation means being attached to each item to be secured and operative to provide an alarm signal in response to a security breach;

a plurality of electrically conducting cables connected to the alarm signal generation means;

a common cable connector means attached to a support member of the display fixture from which the items hang, the common cable connector means having a plurality of electrical connection means for connection with the conducting cables, the electrical connection means spaced substantially along the support member proximate to the and points at which the items of merchandise hang therefrom;

an alarm, electrically connected to the cable connector means, which is activated upon detection of the alarm signal.

19. A display fixture for merchandise, adapted to be connected to an alarm system to signal an alarm when there is a security breach, comprising:

a support member for supporting items of merchandise along its length in a side-by-side arrangement, including a common cable connector means, with a series of spaced electrical connection means, for electrical connection to the alarm system; and a cable, for each item of merchandise, connected to the item at one end and to an electrical connection means at the other end, wherein each item is arranged to hang from the support member in a position proximate an electrical connection means and each respective item cable extends directly from the item to an electrical connection location thereby minimizing entanglement of the item cables.

* * * * *